US007751735B2

(12) United States Patent
Takahashi

(10) Patent No.: US 7,751,735 B2
(45) Date of Patent: Jul. 6, 2010

(54) IMAGE FORMING DEVICE WITH TONER DENSITY DETECTION

(75) Inventor: Osamu Takahashi, Nagoya (JP)

(73) Assignee: Brother Kogyo Kabushiki Kaisha, Aichi-Ken (JP)

( * ) Notice: Subject to any disclaimer, the term of this patent is extended or adjusted under 35 U.S.C. 154(b) by 254 days.

(21) Appl. No.: 11/956,796

(22) Filed: Dec. 14, 2007

(65) Prior Publication Data

US 2008/0145089 A1 Jun. 19, 2008

(30) Foreign Application Priority Data

Dec. 15, 2006 (JP) ..... 2006-339098

(51) Int. Cl.
*G03G 15/00* (2006.01)

(52) U.S. Cl. ..... 399/49; 399/74

(58) Field of Classification Search ..... 399/49, 399/72, 74

See application file for complete search history.

(56) References Cited

U.S. PATENT DOCUMENTS

| | | | |
|---|---|---|---|
| 6,215,968 | B1 | 4/2001 | Uehava et al. |
| 2004/0253012 | A1 * | 12/2004 | Ishibashi ..... 399/49 |

FOREIGN PATENT DOCUMENTS

| | | |
|---|---|---|
| JP | 1-197777 | 8/1989 |
| JP | 2810372 | 7/1998 |
| JP | 2004-101687 | 4/2004 |
| JP | 2004-206137 | 7/2004 |
| JP | 2006-39389 | 2/2006 |

* cited by examiner

*Primary Examiner*—Hoang Ngo
(74) *Attorney, Agent, or Firm*—Scully, Scott, Murphy & Presser, P.C.

(57) ABSTRACT

An image-forming device has an image-forming unit, a toner density detection unit, a reflective shutter, a storage unit, and a control unit. The control unit calculates a correction value for correcting the output value to control an image-forming unit according to the correction value. The image-forming unit forms a reference toner image on the image-carrying member. The toner density detection unit receives a reflected light beam from the reflective shutter positioned at the shielding position to generate a first output value, the first output value being stored in the storage unit. The toner density detection unit receives another reflected light beam from the reference toner image to generate a second output value when the reflective shutter is positioned at the retracted position, the second output value being stored in the storage unit. The control unit calculates a ratio of the second value and the first value and then calculates the correction value based on the ratio.

6 Claims, 12 Drawing Sheets

IMAGE FORMING DEVICE WITH TONER DENSITY DETECTION

CROSS REFERENCE TO RELATED APPLICATIONS

This application claims priority from Japanese Patent Application No. 2006-339098 filed Dec. 15, 2006. The entire content of this priority application is incorporated herein by reference.

TECHNICAL FIELD

The present invention relates to an image-forming device, such as a printer, multifunction device, copier, or facsimile machine.

BACKGROUND

The image-forming device performs image formation by supplying toner to an image-carrying member to form an image thereon and subsequently transferring the toner image onto a recording paper. In order to accurately adjust the darkness of the image formed on the recording paper, the image-forming device has a toner quantity detecting device (density sensor) for detecting the quantity (density) of toner deposited on the image-carrying member. Japanese patent application publication No. 2004-101687 discloses an image-forming device comprising such a toner quantity detecting device.

The density sensor includes a light-emitting element for irradiating a detection light beam onto the image-carrying member, and a light-receiving element for receiving the detection light beam reflected off the image-carrying member and for generating an output. The density sensor detects the density of the toner based on the output from the light-receiving element. The density sensor includes a shutter for covering and exposing the front surfaces of the light-emitting element and light-receiving element. A reflecting reference member is provided on the shutter.

Before detecting the density of toner, the density sensor irradiates the detection light beam from the light-emitting element when the shutter is closed, and sets the resultant output from the light-receiving element as an initial detection value when the light-receiving element receives the detection light beam reflected off the reflecting reference member of the shutter. Hence, even if the performance of the light-emitting element and light-receiving element degrades due to scattered toner, the density sensor maintains the same initial detection state by detecting density after adjusting the sensor output.

Here, in order to control light emission at a uniform intensity, the conventional image-forming device regulates the amount of light emission for each printing operation so that the amount of light reflected off the reflecting reference member when the shutter is in the shielding position is constant. However, in reality, individual sensors have a different response (sensitivity) with respect to the distance from the sensor to the measuring surface. Therefore, regulating the amount of light emission to achieve a constant intensity at the shutter reference position does not guarantee that the amount of light received will be constant, since the actual distance to the image-carrying member on which the patches are measured differs from the distance at which the reflected light is measured.

FIG. 1 shows an output characteristics from first and second density sensors when a reflecting reference member having certain reflection characteristics is positioned a distance of 2.5-5.5 mm from the sensors. The vertical axis in FIG. 1 represents the output from the density sensors, while the horizontal axis represents the distance (mm) between the density sensor and the image-carrying member. Further, the thin solid line in the drawing indicates the detection characteristics of the first density sensor, the bold solid line the detection characteristics of the second density sensor, and the dotted line the detection characteristics of the second density sensor adjusted based on the amount of detection light reflected off the reflecting reference member. As can be seen in FIG. 1, when the reflecting reference member is arranged at a belt position of 5 mm from the first and second density sensors, even when the light emission intensity of the first and second density sensors (solid line and bold line in FIG. 1) is adjusted to achieve a sensor output of 1.5 V for the reflection characteristics of the reflecting reference member. However, the sensor output for other distances may deviate among the two sensors.

On the other hand, when the light emission intensity is adjusted so that the output from both the first and second density sensors is 1.6 V for a shutter position 3 mm from the sensors, as indicated by the dotted line, the second density sensor detects a lower intensity of received light at the belt position of 5 mm than the first density sensor.

The irregularities depicted in FIG. 2 occur due to irregularities in the directivity (intensity distribution) of the light-emitting element and the directivity (sensitivity distribution) of the light-receiving element.

The reflection characteristics of the reflecting reference member (shutter reference) are also difficult to manage with precision. For example, FIG. 2 shows measurements depicting the relationship between an LED current and sensor output when affixing two types of print film on the shutter as the reflecting reference member, where the vertical axis represents output from the density sensor and the horizontal axis represents the LED current (mA). Further, the thin solid line in FIG. 2 indicates the detection characteristics of the sensor when using a reflecting reference member A, and the bold line represents the detection characteristics when using a reflecting reference member B. From FIG. 2, we can see that the sensor output relative to the LED current varies according to which of the reflecting reference members A and B is used.

This difference in sensor output is a result of the amount of ink application or solvent dilution when printing the films. In order to keep the cost of parts low, it is preferable to be able to measure the toner quantity with stability, even when there is a slight irregularity in the reflection characteristics of the reflecting reference member.

It is an object of the present invention to provide an image-forming device which is capable of detecting toner density on an image-carrying member with high precision regardless of deviation or error in the image-forming device.

SUMMARY

The present invention provides an image-forming device having an image-forming unit, a toner density detection unit, a reflective shutter, a storage unit, and a control unit. The image-forming unit forms a toner image on an image-carrying member. The toner density detection unit detects a toner density of the toner image, the toner density detection unit having a light-emitting element for emitting a light, beam to the image-carrying member, and a light-receiving element for receiving the light beam to produce an output value based on an intensity of the received light beam. The reflective shutter is provided between the toner density detection unit and the image-parrying member to be movable between a shielding position and a retracted position. The storage unit stores the output value of the toner density detection unit. The control unit calculates a correction value for correcting the output value to control an image-forming unit according to the correction value. The image-forming unit forms a reference toner image on the image-carrying member. The toner density detection unit receives a reflected light beam from the reflective shutter positioned at the shielding position to generate a first output value, the first output value being stored in the storage unit. The toner density detection unit receives another reflected light beam from the reference toner image to generate a second output value when the reflective shutter is positioned at the retracted position, the second output value being stored in the storage unit. The control unit calculates a ratio of the second value and the first value and then calculates the correction value based on the ratio.

The present invention provides a computer program recorded on a computer readable recording medium for operating an image-forming device, executable by a computer. The image-forming device has an image-forming unit that forms a toner image on an image-carrying member; a toner density detection unit that detects a toner density of the toner image, the toner density detection unit having a light-emitting element for emitting a light beam to the image-carrying member, and a light-receiving element for receiving the light beam to produce an output value based on an intensity of the received light beam; a reflective shutter provided between the toner density detection unit and the image-carrying member to be movable between a shielding position and a retracted position; and a control unit that calculates a correction value for correcting the output value to control the image-forming unit. The program has instructions for receiving reflect light from the reflective shutter positioned at the shield position to generate a first output value, instructions for forming a reference toner image on the image-carrying member, and instructions for receiving another reflected light from the reference toner image to generate a second output value when the reflective shutter is positioned at the retracted position, and instructions for calculating a ratio of the second value and the first value to calculate the correction value based on the ratio.

The present invention provides a toner density detection device used for an image-forming device including an image-carrying member to carry a toner image formed having a toner density thereon. The toner density detection device detects the toner density. The toner density detection device has a light-emitting unit, a light-receiving unit, a reflective shutter, a storage unit, and a control unit. The light-emitting unit emits light to the image-carrying member. The light-receiving unit receives the light to produce an output value based on an intensity of the received light beam. The reflective shutter is provided for the light-emitting unit and movable between a shielding position and a retracted position. The storage unit stores the output value of the light receiving unit. The control unit calculates a correction value for correcting the output value based on a reference toner image formed on the image-carrying member. The control unit produces the tuner density, using the correction value. The light-receiving unit receives the light from the reflective shutter positioned at the shielding position to generate a first output value, the first output value being stored in the storage unit. The light-receiving unit receives the light from the reference toner image to generate a second output value when the reflective shutter is positioned at the retracted position, the second output value being stored in the storage unit. The control unit calculates a ratio of the second value and the first value and then calculates the correction value based on the ratio.

BRIEF DESCRIPTION OF THE DRAWINGS

The particular features and advantages of the invention as well as other objects will become apparent from the following description taken in connection with the accompanying drawings, in which.

DETAILED DESCRIPTION

Next, the image-forming device according to the present invention will be described while referring to FIGS. 3-13. The expressions "front", "rear", "above", and "below" are used throughout the description to define the various parts when the image-forming device is disposed in an orientation in which it is intended to be used.

Figure 1:
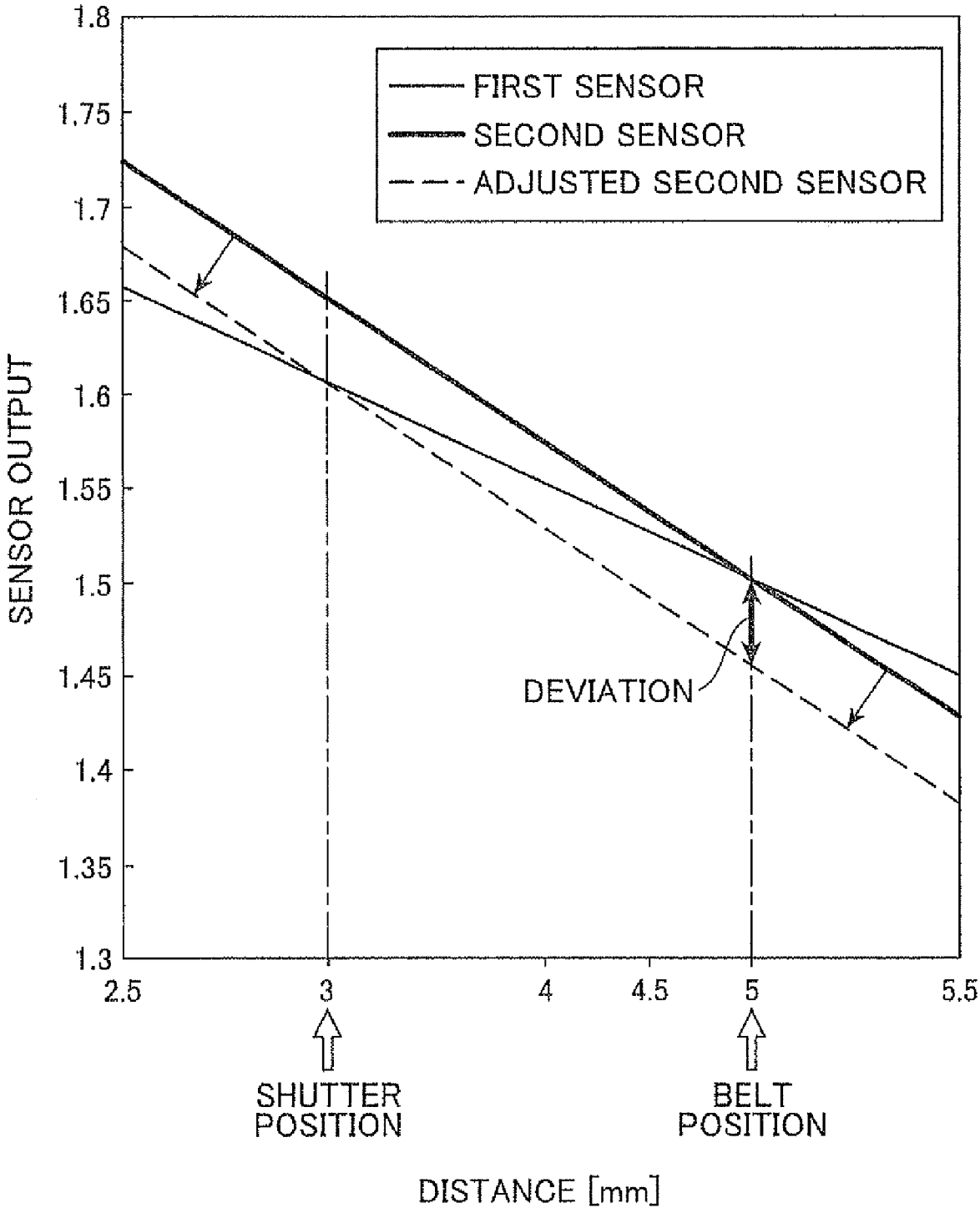
FIG. 1 is a graph showing detection characteristics of density sensors.
Figure 2:
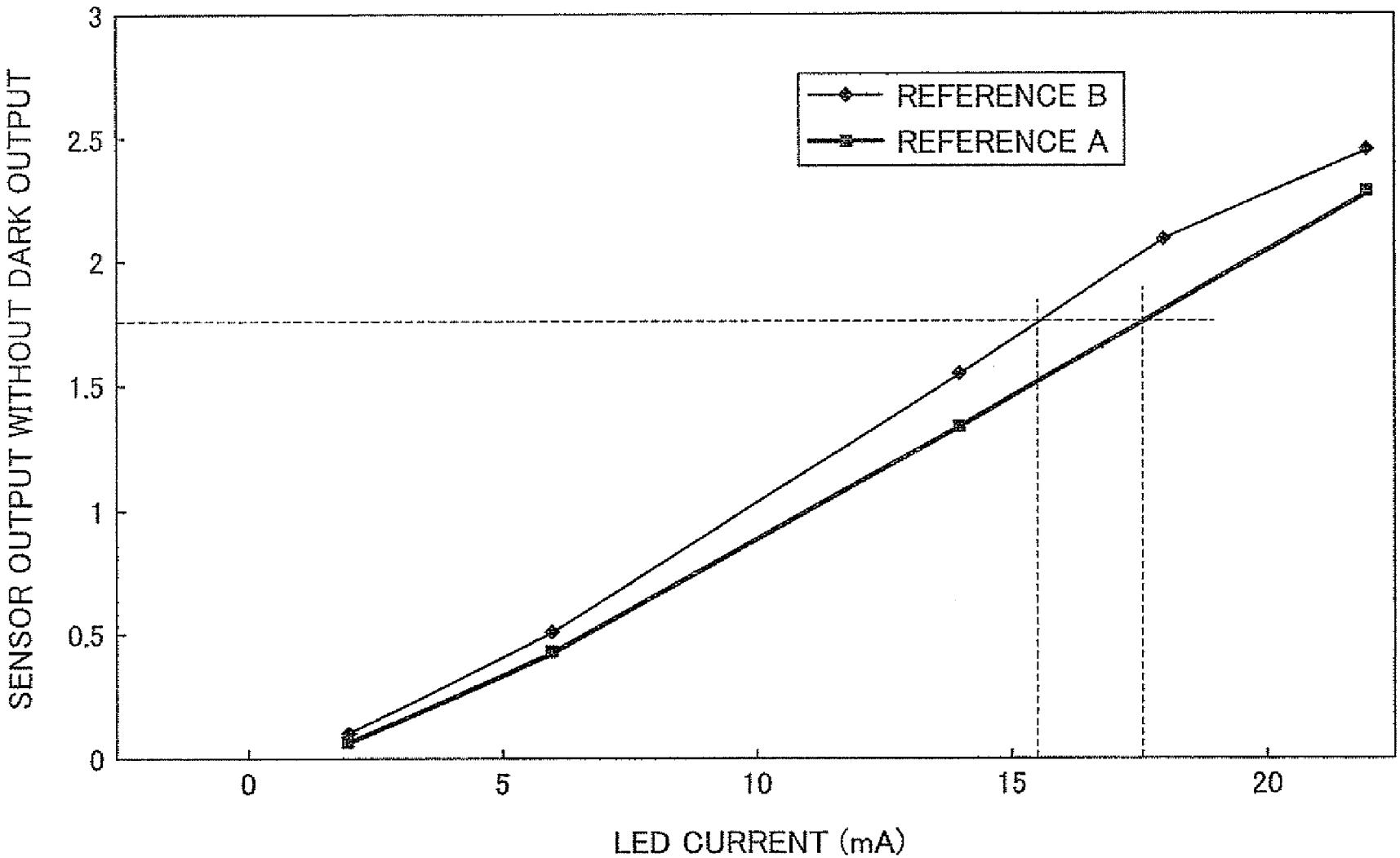
FIG. 2 is a graph showing the detection characteristics of the sensor depending on a reflecting reference member.
Figure 3:
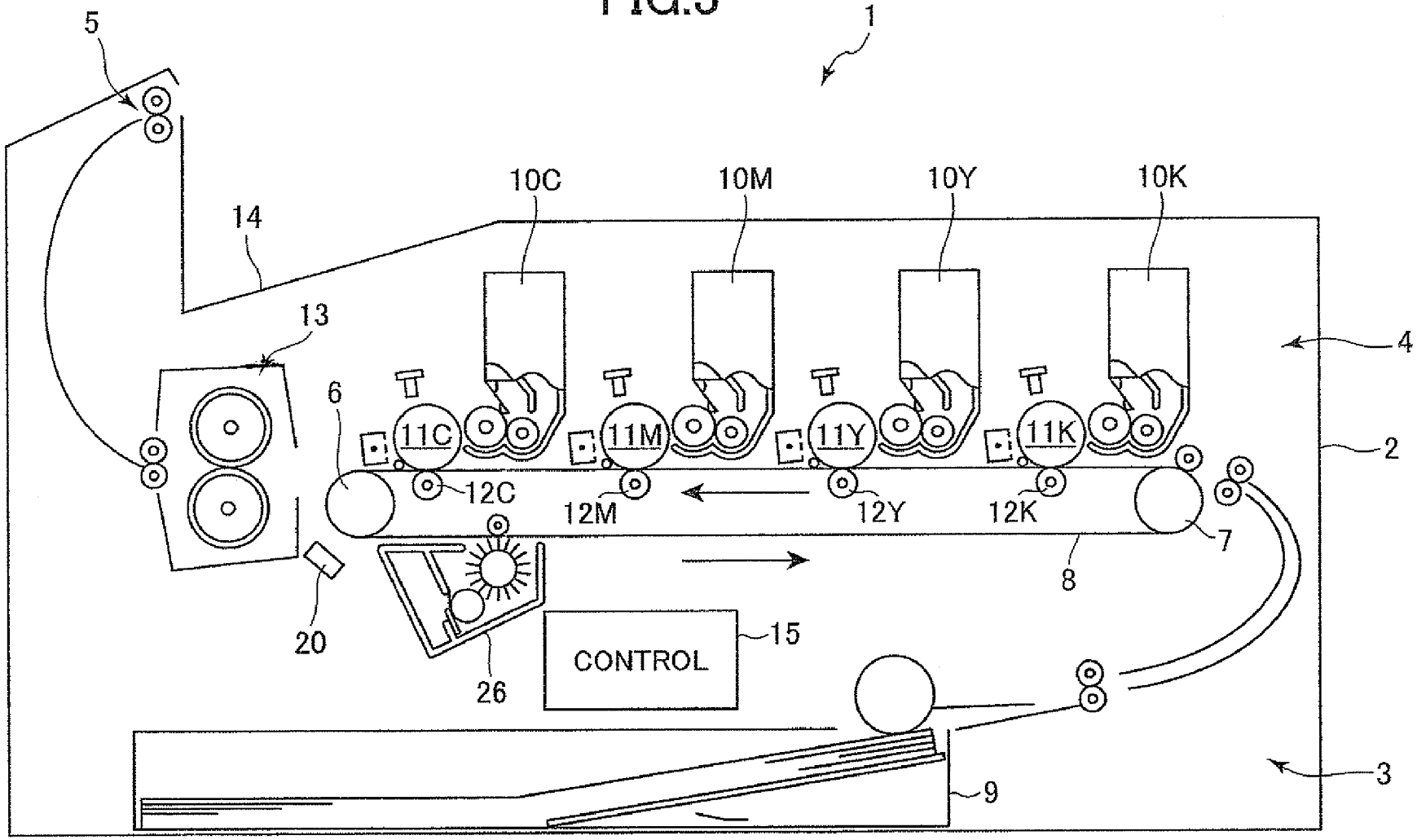
FIG. 3 is a side cross-sectional view showing an image-forming device according to the present invention.

FIG. 3 shows a printer 1 including a casing 2 and, within the casing 2, a feeding unit 3, an image-forming unit 4, and a discharge unit 5. Disposed substantially in the center region of the casing 2 are a drive roller 6, a follow roller 7, and a conveying belt 8 looped around the drive roller 6 and follow roller 7. A paper cassette 9 for accommodating stacked sheets of recording paper is detachably mounted below the conveying belt 8.

The image-forming unit 4 includes four process cartridges 10K, 10Y, 10M, and 10C (hereinafter also referred to as the "process cartridges 10") arranged in order from the upstream side to the downstream side of the conveying belt 8 and accommodating toner in the colors black (K), yellow (Y), magenta (M), and cyan (C). Photosensitive drums 11K, 11Y, 11M, and 11C (hereinafter also referred to as the "photosensitive drums 11") are provided to correspond to the process cartridges 10K, 10Y, 10M, and 10C, respectively, and transfer rollers 12K, 12Y, 12M, and 12C (hereinafter also referred to as "transfer rollers 12") are disposed to confront the photosensitive drums 11K, 11Y, 11M, and 11C through the conveying belt 8. A fixing unit 13 is disposed on the downstream side of the process cartridges 10.

A discharge tray 14 for accommodating recording paper discharged from the discharge unit 5 is provided on the top surface of the casing 2. A controller 15 controls the operations of the printer 1.

With the printer 1 having the above construction, the feeding unit 3 picks up the recording paper in the paper cassette 9 one sheet at a time and feeds the sheets to the image-forming unit 4. The conveying belt 8 conveys each sheet of recording paper through the image-forming unit 4. The conveying belt 8 circulates in a clockwise direction in FIG. 3.

At this time, the image-forming unit 4 irradiates laser beams onto the surfaces of the photosensitive drums 11 to form electrostatic latent images thereon, and toner in the colors black, yellow, magenta, and cyan is supplied from the process cartridges 10 onto the respective photosensitive drums 11 to develop the latent images into visible images. The toner carried on the photosensitive drums 11 is subsequently transferred onto the recording paper at transfer positions between the photosensitive drums 11 and the respective transfer rollers 12. Next, the toner is thermally fixed to the recording paper by heat in the fixing unit 13.

The image-forming unit 4 can form more clear images on the recording paper when suitable values are set for the exposure intensity of the laser beams, developing bias voltage, transfer bias voltage, and other conditions, as image-forming conditions.

After an image has been formed on the recording paper, the discharge unit 5 discharges the paper onto the discharge tray 14 in a stacked state.

A density sensor 20 is also provided at a position downstream of the portion opposing the fixing unit 13 in the moving direction of the belt 8. A cleaner 26 is provided downstream of the density sensor 20 in the moving direction for cleaning the conveying belt 8 to scrap off toner deposited thereon. The cleaner 26 collects waste toner scraped off the conveying belt 8 to prevent the waste toner from scattering.

Figure 4:
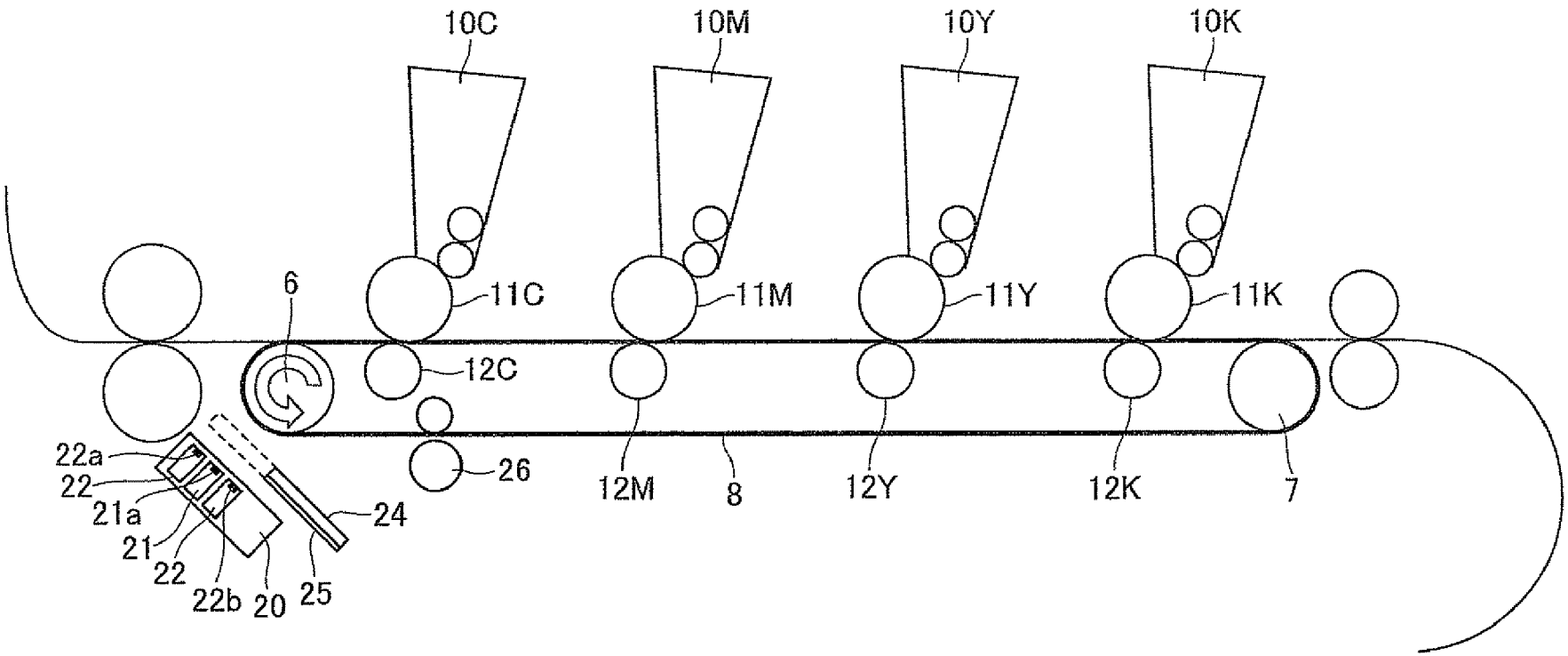
FIG. 4 is an explanatory diagram conceptually illustrating the density sensor.

As shown in FIG. 4, the density sensor 20 includes a light-emitting element 21, and a light-receiving element 22. A shutter 24 is disposed on the front side of the density sensor 20, i.e. between the density sensor 20 and the conveying belt 8.

A drive motor (not shown) is configured to move the shutter 24 linearly between a shielding position (indicated by the dotted line in FIG. 4) for covering the density sensor 20 and protecting the density sensor 20 from dust, and a retracted position (indicated by the solid line in FIG. 4) for exposing the density sensor 20.

A print film 25 is fixed to the rear surface of the shutter 24 opposing the density sensor 20. The print film 25 is provided between the density sensor 20 and the conveying belt 8. And the print film 25 can be moved between the shielding position covering the density sensor 20 and the retracted position exposing the density sensor 20. The print film 25 is coated with ink dissolved in a solvent to obtain a prescribed reflectance.

In the density sensor 20 described above, an infrared LED 21*a* is provided on the light-emitting element 21 for projecting infrared light to the conveying belt 8. The infrared light is reflected by the print film 25 when the shutter 24 is in the shielding position. And, the infrared light is reflected by the base of the conveying belt 8 or toner deposited on the conveying belt 8 when the shutter 24 is in the retracted position.

The light-receiving element 22 is provided with a specular reflection photodiode 22*a* for detecting the is specular reflection component of the reflected light, and a diffuse reflection photodiode 22*b* for detecting the diffuse reflection component of the reflected light.

Figure 5:
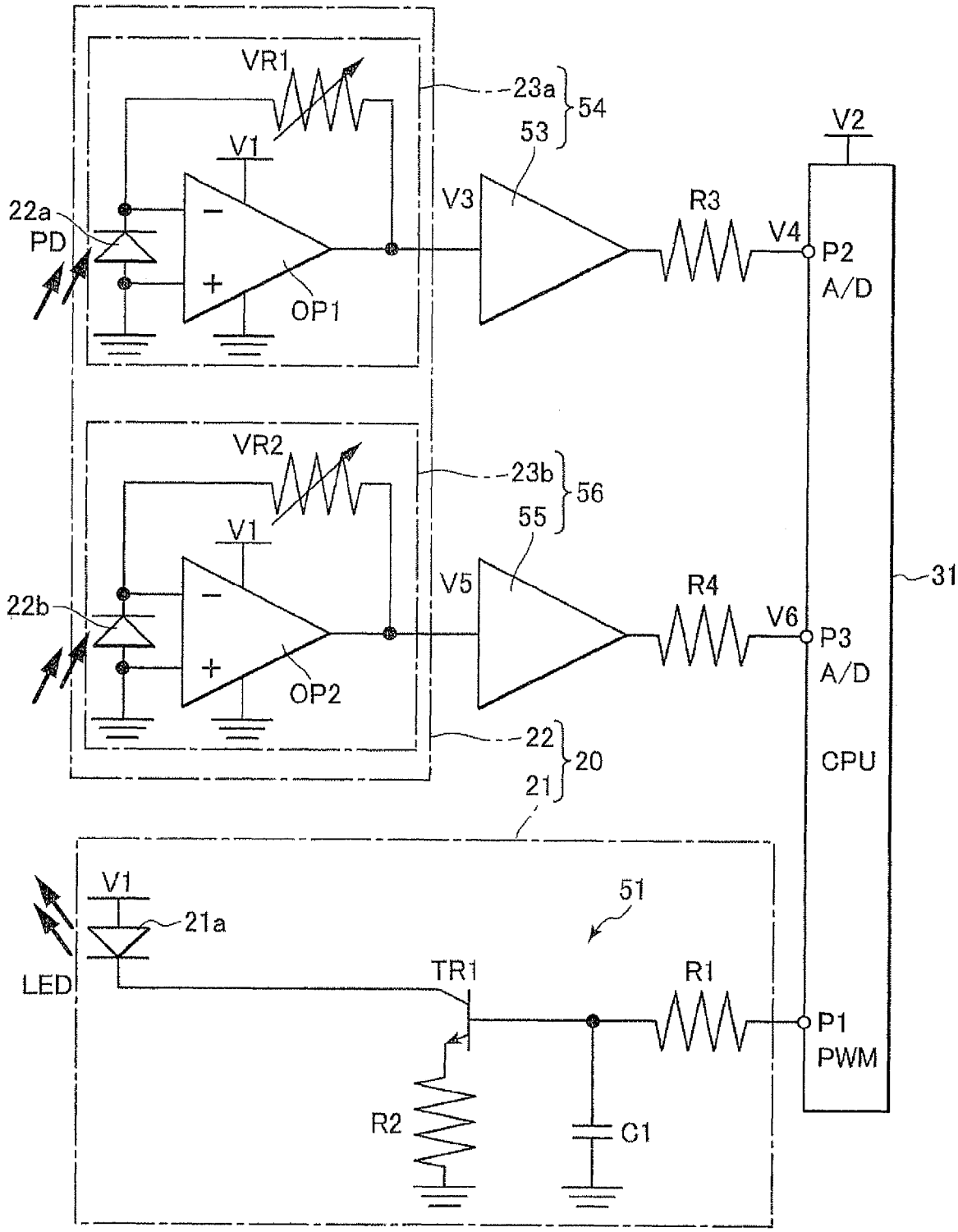
FIG. 5 is a circuit diagram illustrating the density sensor.

Next, the peripheral circuit structure including the density sensor 20 will be described with reference to FIG. 5. The light-emitting element 21 is configured of the infrared LED 21*a*, and a drive circuit 51 for driving the infrared LED 21*a*. The drive circuit 51 is configured of a transistor TR1 with a collector terminal connected to one side of the infrared LED 21*a*, and a resistor R1 with one end connected to a PWM (pulse width modulation) output terminal P1 of a CPU 31 described later and the other end connected to the base terminal of the transistor TR1. The emitter terminal of the transistor TR1 is grounded via a resistor R2. Further, one end of a capacitor C1 is connected between the resistor R1 and the base terminal of the transistor TR1, while the other end is grounded. The anode side of the infrared LED 21*a* is connected to a power supply circuit (not shown) to apply a voltage V1 thereto, while the cathode side is connected to the collector terminal of the transistor TR1.

The PWM signal outputted from the PWM output terminal P1 of the CPU 31 is smoothed by the resistor R1 and capacitor C1, and the smoothed analog signal is supplied to the base terminal of the transistor TR1. A current corresponding to the current of the analog signal supplied to the transistor TR1 flows through the infrared LED 21*a*, causing the infrared LED 21*a* to irradiate light. Hence, the intensity of light emitted from the infrared LED 21*a* is regulated based on the duty cycle of the PWM signal outputted from the PWM output terminal P1.

The light-receiving element 22 includes a specular reflection light-receiving element 23*a*, and a diffuse reflection light-receiving element 23*b*. The specular reflection light-receiving element 23*a* is configured of the specular reflection photodiode 22*a* described above, and a current/voltage converter for converting the current flowing through the specular reflection photodiode 22*a* to a voltage signal. The current voltage converter is implemented with an operational amplifier (op amp) OP1 and a variable resistor VR1. More specifically, one end of the specular reflection photodiode 22*a* is connected to an inverting input terminal of the op amp OP1, while the other end is connected to a non-inverting input terminal of the op amp OP1. One end of the variable resistor VR1 functioning as a feedback resistor is connected to the output terminal of the op amp OP1, while the other end is connected to the inverting input terminal. The current voltage converter determines a voltage V3 based on the value of electric current flowing through the specular reflection photodiode 22*a* in response to the intensity of incident light on the specular reflection photodiode 22*a* and the resistance value of the variable resistor VR1.

An amplifier circuit 53 is configured to output an output voltage V4 produced by amplifying the voltage V3 received from the specular reflection light-receiving element 23*a*. The specular reflection light-receiving element 23*a* and the amplifier circuit 53 constitute a specular reflection light-receiving sensor 54.

One end of a resistor R3 is connected to the output terminal of the amplifier circuit 53, while the other end is connected to an A/D input terminal P2 of the CPU 31. The output voltage V4 is inputted into the core region of the CPU 31 via a built-in A/D converter.

The diffuse reflection light-receiving element 23*b* is configured of the diffuse reflection photodiode 22*b*, and a current-voltage converter for converting electric current flowing through the diffuse reflection photodiode 22*b* into a voltage signal. The current/voltage converter is implemented by an op amp OP2 and a variable resistor VR2. More specifically, one end of the diffuse reflection photodiode 22*b* is connected to the inverting input terminal of the op amp OP2, while the other end is connected to the non-inverting input terminal of the op amp OP2. One end of the variable resistor VR2 serving as a feedback resistor is connected to the output terminal of the op amp OP2, while the other end is connected to the inverting input terminal. The current/voltage converter determines an output voltage V5 based on the value of the electric current flowing through the diffuse reflection photodiode 22*b* in response to the intensity of light incident on the diffuse reflection photodiode 22*b* and the resistance value of the variable resistor VR2.

An amplifier circuit 55 is configured to output an output voltage V6 by amplifying the output voltage V5 received from the diffuse reflection light-receiving element 23*b*. The diffuse reflection light-receiving element 23*b* and the amplifier circuit 55 constitute a diffuse reflection light-receiving sensor 56.

One end of a resistor R4 is connected to the output terminal of the amplifier circuit 55, while the other end is connected to an A/D input terminal P3 of the CPU 31. The output voltage V6 is inputted into the core region of the CPU 31 via a built-in A/D converter.

Figure 6:
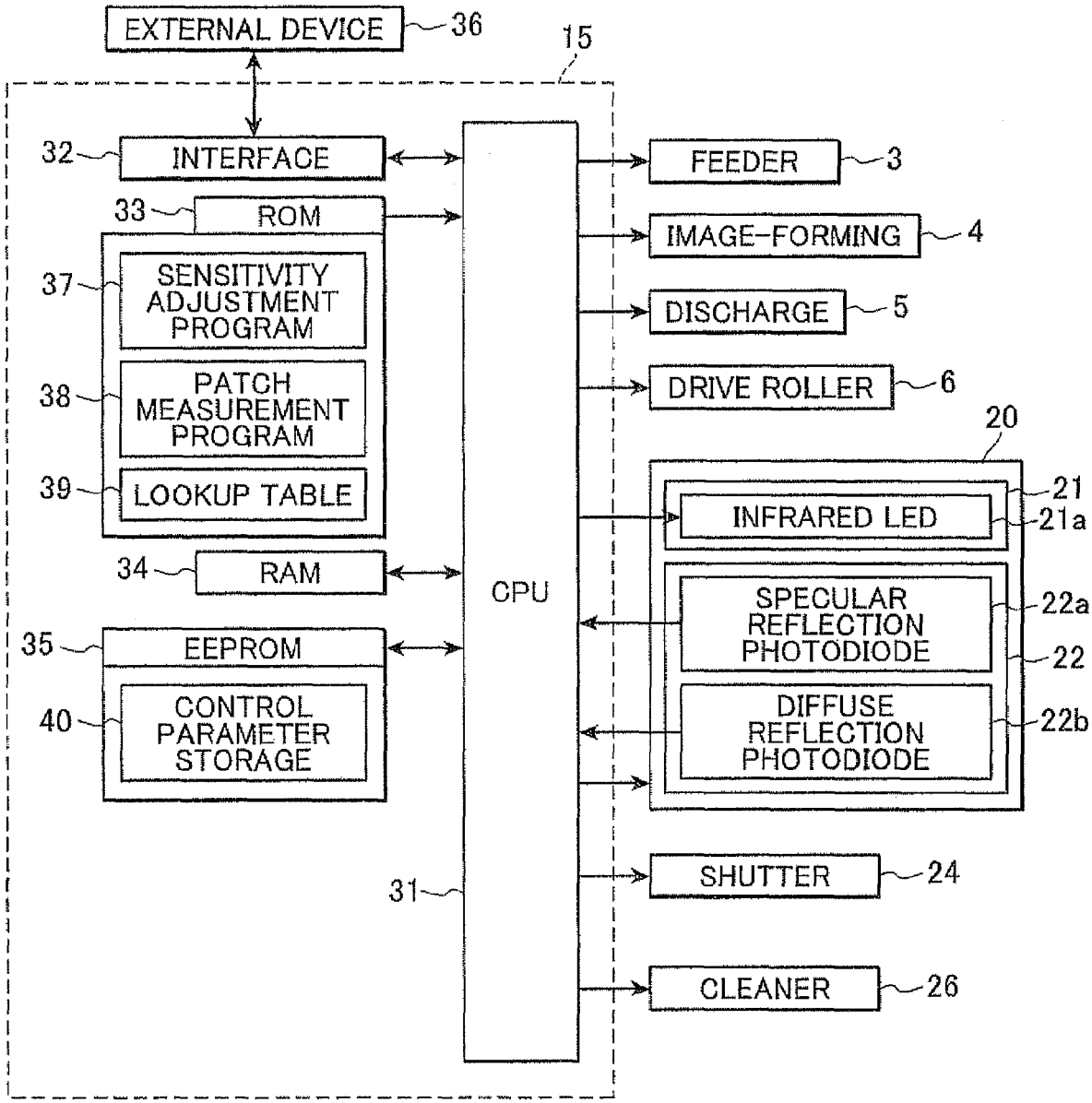
FIG. 6 is a block diagram showing a controller for the image-forming device.

As shown in FIG. 6, the controller 15 includes the CPU 31; and an interface 32, ROM 33, RAM 34, and EEPROM 35 connected to the CPU 31. The controller 15 controls the operations of the printer 1 according to a program, The CPU 31 performs data processing and arithmetic computations. The interface 32 exchanges data with an external device 36, such as a personal computer or an external memory device (USB memory device, CD-ROM device, or floppy disk drive).

The ROM 33 is a read-only nonvolatile memory for storing various data and programs. In this embodiment, the ROM 33 stores a sensitivity adjustment program 37, a patch measurement program 38, and a lookup table 39.

The CPU 31 executes the sensitivity adjustment program 37 at the after product assembly or during maintenance. The sensitivity adjustment program 37 calculates and stores a correction coefficient coef as a correction value for adjusting the response of the density sensor 20, the amount of light emitted from the light-emitting element 21, or the reflection characteristics of the print film 25 relative to the distance from the density sensor 20 to the surface of the conveying belt 8.

The patch measurement program 38 is executed to calibrate the patch density detected by the density sensor 20 and to calculate the amount (density) of deposited toner.

Figure 7:
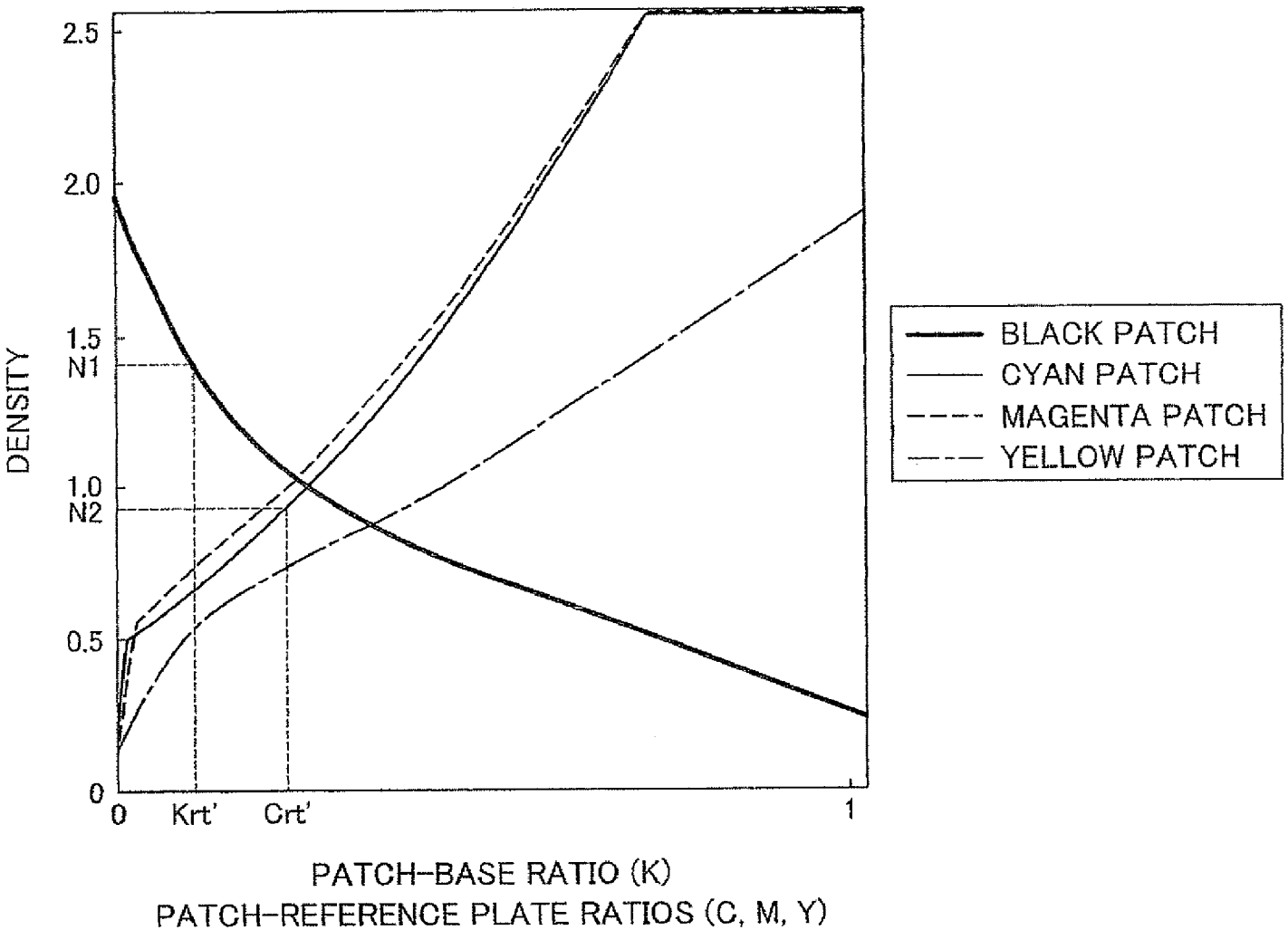
FIG. 7 is a graph illustrating contents in a lookup table.

As shown in FIG. 7, the lookup table 39 is used to calculate the density for each color of toner. In FIG. 7, the vertical axis represents toner density, while the horizontal axis indicates the ratio of a patch formed in black toner (K) and the base of the belt, and patches formed in colored toner (C, Y, and M) to the reference plate (reflecting reference member). The lookup table 39 stores correlations between the density and the reflection ratio of the patch formed in black toner on the conveying belt 8 and the base of the conveying belt 8 as map data. And, the lookup table 39 stores the relationship between the density and the reflection ratios of patches formed in color toner on the conveying belt 8 and the print film 25, as map data.

Returning to FIG. 6, the RAM 34 is a rewritable volatile memory for storing various data and programs.

The EEPROM 35 is a readable and writable nonvolatile memory for storing various data. In this embodiment, the EEPROM 35 is provided with a control parameter storage area 40.

The control parameter storage area 40 initially stores "a filled black standard reference Krt_std". The "filled black standard reference Krt_std" is calculated by dividing a design value for sensor output Vdfb_adj_std based on a filled black patch 61 described later by a design value for sensor output Vdf_pat_std based on the shutter 24. Hence, "the filled black standard reference Krt_std" defines a designed correspondence (intended ratio) between sensor output based on the filled black patch 61 and sensor output based on the shutter 24.

The control parameter storage area 40 also stores "the correction coefficient coef" acquired when the sensitivity adjustment program 37 is executed. The control parameter storage area 40 also stores initial values, reference values, and threshold values used when executing the sensitivity adjustment program 37 and patch measurement program 38. It should be noted that these values are output voltages which are produced by the photodiodes 22*a* and 22*b* and converted by the current-voltage converter. For example, in this embodiment, the control parameter storage area 40 stores "an initial specular reflection light emission setting bk0_led_pwm", "an initial diffuse reflection light emission setting co10_led_pwm", "base determining values V_base_max, min", "black patch density determining values Vsp_belt_min,max", "color patch density determining values Vdf_belt_min,max", and "an initial sensitivity adjustment light emission setting X0**_led_pwm".

The "initial specular reflection light emission setting bk0_led_pwm" is a control value used to obtain an initial intensity of the light emitted from the light-emitting element, when the intensity of light emitted by the LED 21*a* is adjusted for measuring the specular reflection from the toner patch.

The "initial diffuse reflection light emission setting co10_led_pwm" is a control value used to obtain an initial intensity of the light emitted from the light-emitting element, when the intensity of light emitted by the LED 21*a* is adjusted for measuring the diffuse reflection from the toner patch.

The "base determining values V_base_max,min" are a value obtained by emitting an infrared light from the LED 21***a* to the base of the belt 8 and receiving the reflected light by the specular reflection photodiode 22*a* and the diffuse reflection photodiode 22*b*. If V_base_max,min is within the range between V_base_min and V_base_max, V_base_max,min can be used for forming the toner patch on the belt.

The "black patch density determining values Vsp_belt_min,max" are reference values used to determine the toner density of black toner patch.

The "color patch density determining values Vdf_belt_min,max" are reference values used to determine the toner density of each color patch.

The "initial sensitivity adjustment light emission setting X0_led_pwm" is a control value used to obtain an initial intensity of the light emitted from the light-emitting element, when the intensity of light emitted by the LED 21*a* is adjusted for adjusting the sensitivity.

The control parameter storage area 40 also stores a filled black specular reflection level bk_sld, which is initially stored in the printer 1 as a constant indicating the ideal measurement level for a filled black patch.

The CPU 31 is also connected to the feeding unit 3, image-forming unit 4, discharge unit 5, and drive roller 6 for controlling printing operations. Additionally, the CPU 31 is connected to the infrared LED 21*a*, specular reflection photodiode 22*a*, and diffuse reflection photodiode 22*b* of the density sensor 20; the shutter 24; and the cleaner 26 for controlling toner density detection operations.

Both the sensitivity adjustment program 37 and the patch measurement program 38 are executed to measure the density of toner patches. First, the toner patches printed on the conveying belt 8 in the sensitivity adjustment program 37 and patch measurement program 38 will be described.

Figure 8:
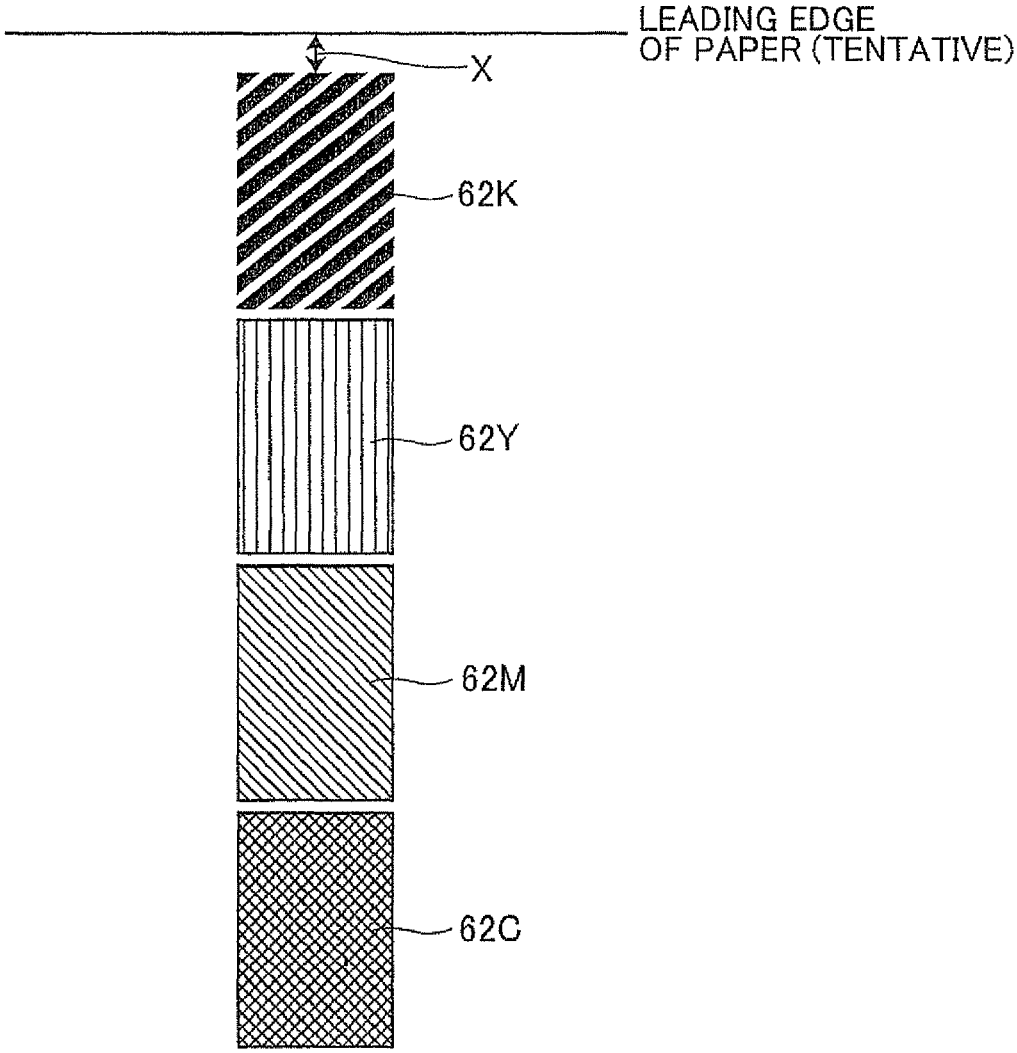
FIG. 8 is an explanatory diagram showing toner patches formed for measuring purposes.

When executing the patch measurement program 38 stored in the ROM 33, the printer 1 directly forms four toner patches 62K, 62Y, 62M, and 62C (hereinafter also referred to as the "patches 62") with the colors black, yellow, magenta, and cyan on the conveying belt 8 beginning a distance of X mm after a tentative leading edge position, as shown in FIG. 8. The toner patches 62 are all formed at the same size.

Figure 9:
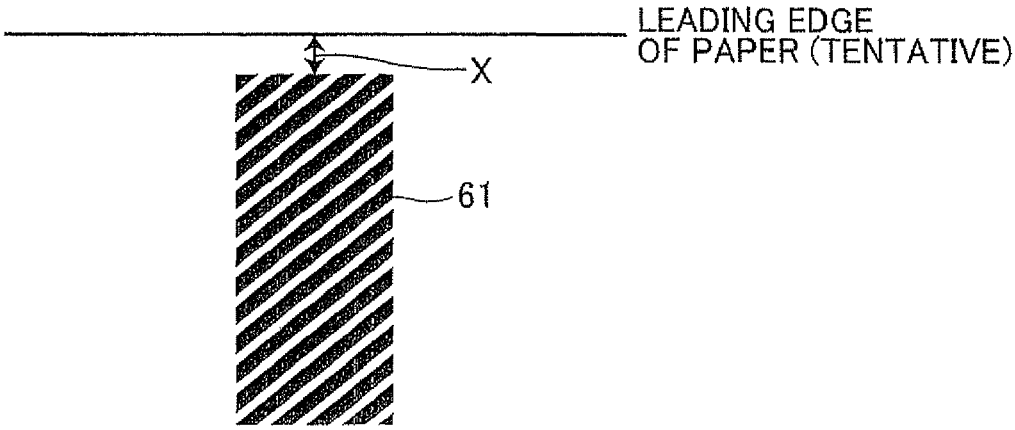
FIG. 9 is an explanatory diagram showing a filled path for adjusting sensitivity.

When executing the sensitivity adjustment program 37 stored in the ROM 33, the printer 1 forms a filled black patch 61 for sensitivity adjustments at substantially the same position as the patch 62K used for patch measurements, as shown in FIG. 9. The filled black patch 61 is an example of the reference toner image. Specifically, the printer 1 forms the filled black patch 61 for sensitivity adjustments directly on the conveying belt 8 beginning a distance X mm after the tentative leading edge position of the paper.

Next, the relationship between the patches 61 and 62 formed on the conveying belt 8 and the programs 37 and 38 will be described.

The surface of the conveying belt 8 has a shiny base so that the light reflected off the conveying belt 8 has a large specular reflection component. On the other hand, the light reflected off the conveying belt 8 has a very small diffuse reflection component since the base is black and includes carbon.

Figure 10:
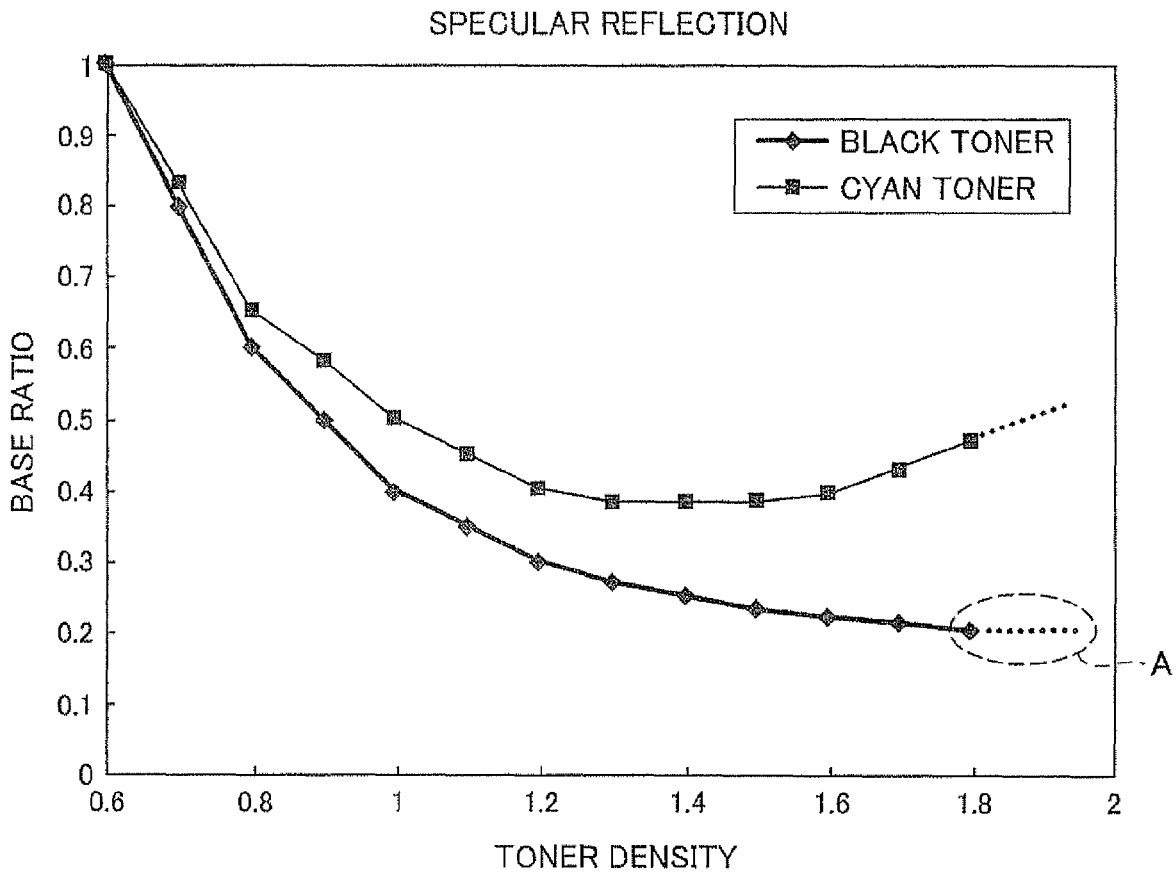
FIG. 10 is a graph showing specular reflection characteristics of toners.

The black toner contains carbon black as a colorant, giving the toner a capacity for absorbing infrared light emitted from the infrared LED 21*a* of the light-emitting element 21. When black toner is deposited on the conveying belt 8, the specular reflection component of light reflected off the conveying belt 8 decreases as the amount of deposited toner increases, as shown in FIG. 10. Hence, the density of deposited black toner can be detected using the specular reflection characteristics. The sensor detection characteristics relative to the density of deposited black toner depict a decay curve approaching the curve of a logarithmic function.

The sensor output for color toner (cyan toner in the example of FIG. 10), on the other hand, decreases up to a prescribed density of deposited toner, but increases after the density of deposition exceeds the prescribed value. Hence, it is difficult to detect the deposition density of color toner with the specular reflection characteristics.

Figure 11:
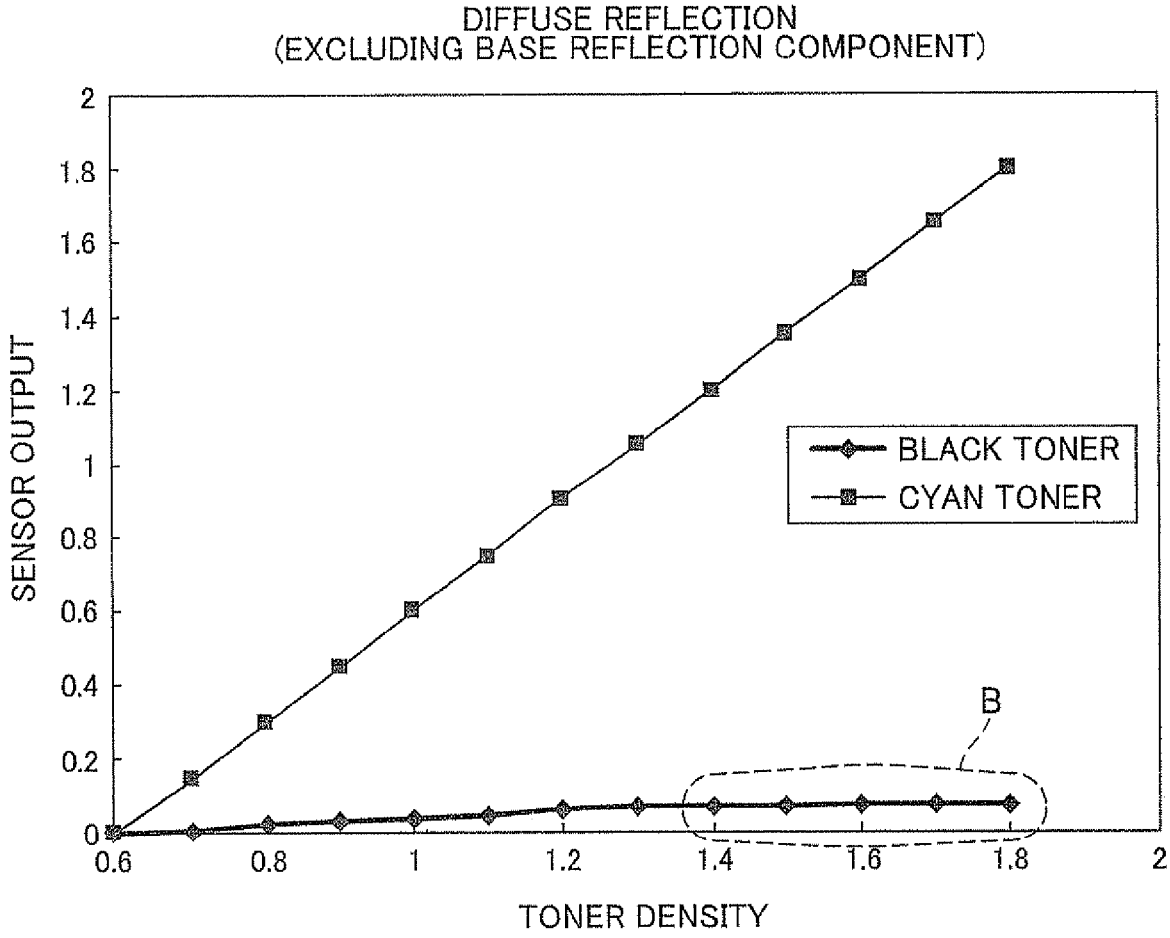
FIG. 11 is a graph showing diffuse reflection characteristics of toners.

Color toner (cyan, magenta, and yellow toner in this embodiment) absorbs very little light of wavelengths in the infrared range, but diffusely reflects such light. Since the light reflected off the base of the conveying belt 8 has a very small diffuse reflection component, the diffuse reflection characteristics of cyan toner increase as the density of deposited toner increases, as shown in FIG. 11. Accordingly, the deposition amount for cyan toner can be detected using the diffuse reflection characteristics. Sensor detection properties for the amount (density) of deposited cyan toner depict a monotonically increasing straight line. The other color toners have similar properties to that of cyan toner.

As indicated in a region A of FIG. 10, as the density of black toner increases, an output from the density sensor 20 approaches a saturated state having very little change, but does not reach zero (i.e., the amount of reflected light does not reach zero). This is probably because a very small diffuse reflection component is incident on the specular reflection photodiode 22*a*. This small component is not dependent on the specular reflection properties of the conveying belt 8.

As indicated in a region B of FIG. 11, the diffuse reflection component detected in a saturated state is not dependent on the base of the conveying belt 8. Using these diffuse reflection characteristics, the filled black patch 61 for sensitivity adjustments is formed on the conveying belt 8 when calculating the correction coefficient.

The filled black patch 61 for sensitivity adjustments is formed larger than the patches 62 for density measurements because measurements are taken at several locations in the patch during one execution of the sensitivity adjustment program 37. An average value is taken of the plurality of measured values to suppress irregular values sampled at different positions in order to measure the patch level more accurately.

Figure 12:
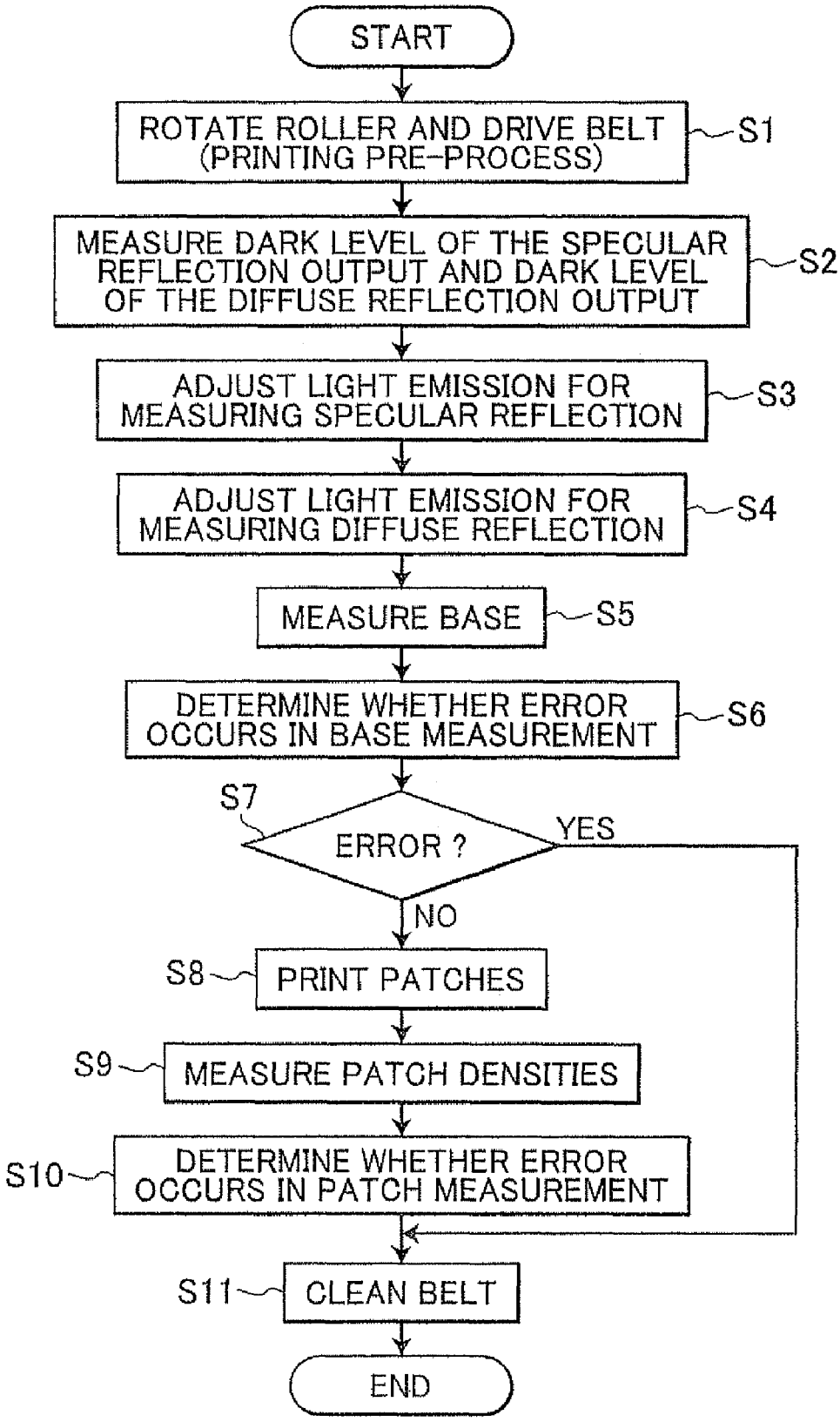
FIG. 12 is a flowchart illustrating a patch measurement program.

Next, a patch measuring function of the printer 1 will be described. The patch measuring function illustrated in the flowchart of FIG. 12 is executed when the power to the printer 1 is turned on and the patch measurement program 38 is copied from the ROM 33 to the RAM 34.

By executing the patch measurement program 38, the CPU 31 drives the drive roller 6 in S1 to rotate the conveying belt 8.

In S2 the CPU 31 measures a dark level of "the specular reflection output Vsp_drk" and a dark level of "the diffuse reflection output Vdf_drk." Initially, the shutter 24 is disposed in the shielding position indicated by the dotted line in FIG. 4 so that the infrared light emitted from the infrared LED 21*a* is projected onto the shutter 24. In this state, the CPU 31 samples sensor outputs from the specular reflection photodiode 22*a* and the diffuse reflection photodiode 22*b* of the light-receiving element 22. And, the CPU 31 stores each value in the RAM 34 as the dark level of "the specular reflection output Vsp_drk" and the dark level of "the diffuse reflection output Vdf_drk," respectively.

At this time, the CPU 31 compares the dark level of "the specular reflection output Vsp_drk" and the dark level of "the diffuse reflection output Vdf_drk" to a determining value V_drk_max,min. And, the CPU 31 cancels the patch measurement program 38** with an error message if there is any abnormality, in order to reduce the amount of waste toner.

In S3 the CPU 31 adjusts the intensity of light used for measuring specular reflection. More specifically, the CPU 31 reads "the initial specular reflection light emission setting bk0_led_pwm" from the control parameter storage area 40. With the shutter 24 in the shielding position indicated by the dotted line in FIG. 4, the CPU 31 begins operating the sensor using "the initial specular reflection light emission setting bk0_led_pwm" to project the infrared light from the infrared LED 21*a*. The CPU 31 gradually increases the intensity of light emitted from the infrared LED 21*a* by steps until the intensity of infrared light reflected off the print film 25 and received by the specular reflection photodiode 22*a* reaches a prescribed intensity (bk_std_tglvl). Here, the adjusted intensity of received light is a value excluding the dark output component. The CPU 31 can increase the intensity of light emitted from the infrared LED 21*a* by increasing the duty cycle of the PWM signal outputted from the PWM output terminal P1.

The CPU 31 may generate an error message if the intensity of received light is greater than the prescribed level (bk_std_max) at "the initial specular reflection light emission setting bk0_led_pwm". The CPU 31 may also generate an error message and cancel the patch measurement program, if the intensity of emitted light is being increased, and the duty cycle of the PWM signal exceeds "the determining value bk_led_pwm_max" before the intensity of the diffuse reflection component reaches a normal range.

After adjusting the intensity of light emitted for measuring specular reflection, the CPU 31 stores the condition for the adjusted intensity of light as "the light emission setting bk_led_pwm," i.e., the duty cycle of the PWM signal in the RAM 34. The CPU 31 also stores a diffuse reflection light emission level when measuring the reference plate bk_std_lvl in the RAM 34 as a reference plate diffuse reflection intensity for measuring "the filled black patch Vdfb_std."

In S4 the CPU 31 adjusts the intensity of light for measuring diffuse reflection. This adjustment is identical to the process for adjusting the intensity of light for measuring specular reflection in S3. Specifically, the CPU 31 gradually increases the intensity of light emitted from the infrared LED 21*a* in steps based on the initial diffuse reflection light emission setting co10_led_pwm stored in the control parameter storage area 40 until the intensity of reflected light received by the diffuse reflection photodiode 22*b* reaches a prescribed value (col_std_tglvl).

The CPU 31 should may generate an error message if the intensity of received light is greater than the prescribed level (col_std_max) at the initial light emission setting. Further, the CPU 31 may cancel the patch measurement program, if the amount of emitted light is being increased, and the duty cycle of the PWM signal exceeds the determining value (col_led_pwm_max) before the amount of the diffuse reflection component reaches a normal range.

After adjusting the intensity of emitted light for measuring diffuse reflection, the CPU 31 stores the conditions for the adjusted intensity of emitted light as "the light emission setting col_led_pwm" (the duty cycle of the PWM signal) in memory. The CPU 31 also saves the diffuse reflection received light intensity measured for the reference plate in the RAM 34 as a reference plate diffuse reflection output for measuring color patches Vdf_std.

In S5 the CPU 31 measures the base of the conveying belt 8. Specifically, the CPU 31 moves the shutter 24 from the shielding position indicated by the dotted line in FIG. 4 to the retracted position indicated by the solid line while the conveying belt 8 is rotating, exposing the density sensor 20. Next, the CPU 31 forms the toner patches 62K, 62Y, 62M, and 62C for patch measurement and samples the base data in predetermined locations for measuring the toner patches.

For example, the infrared LED 21*a* projects infrared light onto a predetermined position for measuring the toner patch 62K, i.e. for measuring specular reflection, using "the light emission setting bk_led_pwm" for measuring specular reflection that is stored in the RAM 34 in S3. And, the specular reflection photodiode 22*a* receives the reflected light. The CPU 31 stores output from the specular reflection photodiode 22*a* in the RAM 34 as a belt base specular reflection output at "a black patch position Vspk_base".

Further, the infrared LED 21*a* projects the infrared light on predetermined positions for measuring the toner patches 62Y, 62M, and 62C, i.e. positions for measuring diffuse reflection, using "the light emission setting col_led_pwm" for measuring diffuse reflection that is stored in the RAM 34 in S4, while the diffuse reflection photodiode 22*b* receives the reflected light. Next, the CPU 31 stores output from the diffuse reflection photodiode 22*b* in the RAM 34 as a belt base diffuse reflection output at "a yellow patch position Vdfy_base," belt base diffuse reflection output at "a magenta patch position Vdfm_base," and belt base diffuse reflection output at "a cyan patch position Vdfc_base."

In S6 the CPU 31 determines whether there is any base error. Specifically, the CPU 31 reads the base determining values V_base_max,min from the control parameter storage area 40, and determines whether there was base error based on whether the belt base specular reflection output at a black patch position Vspk_base, belt base diffuse reflection output at a cyan patch position Vdfc_base, belt base diffuse reflection output at a magenta patch position Vdfm_base, and belt base diffuse reflection output at a cyan patch position Vdfc_base fall within the base determining values V_base_max,min.

If any of the belt base specular reflection outputs Vspk_base, Vdfc_base, Vdfm_base, or Vdfc_base falls outside "the base determining values V_base_max,min," then the CPU 31 determines that a base error has occurred (S7: YES) and advances to S11**.

However, if all output values fall within "the base determining values V_base_max,min," then the CPU 31 determines that there is no base error (S7: NO) and in S8 performs a process to print the toner patches. In other words, the CPU 31 prints the toner patches 62K, 62Y, 62M, and 62C in black, yellow, magenta, and cyan on the conveying belt 8, as shown in FIG. 8**.

In S9 of FIG. 12, the CPU 31 measures the toner patch densities. Specifically, the CPU 31 finds "a black toner-base ratio Krt'," which is the reflection ratio of the black patch 62K and the base of the conveying belt 8 using the correction coefficient coef (for color toner, the CPU 31 finds "color toner-reference plate ratios Yrt', Mrt', and Crt'," which are the reflection ratios for the patches 62Y, 62M, and 62C and the print film 25). The CPU 31 calculates the toner density by referencing the lookup table 39 stored in the ROM 33 with the ratios found above.

Specifically, while the shutter 24 is in the retracted position indicated by the solid line in FIG. 4, the infrared LED 21*a* projects infrared light on the black patch 62K using "the light emission setting bk_led_pwm" for measuring specular reflection that is stored in the RAM 34 in S3, while the specular reflection photodiode 22*a* receives the light reflected off the black patch 62K. The CPU 31 stores output from the specular reflection photodiode 22*a* in the RAM 34 as "a black patch specular reflection output Vspk_pat".

Conventionally, a black toner-base ratio Krt has been calculated from equation (1) below.

$$Krt=(Vspk_pat-Vsp_drk-bk_sld)/(Vspk_\text{base}-Vsp_drk-bk_sld) \quad (1)$$

More specifically, the black toner-base ratio Krt is calculated by dividing (a) a value obtained by subtracting the dark level of "the specular reflection output Vsp_drk" from "the black patch specular reflection output Vspk_pat" and further subtracting "the filled black specular reflection level bk_sld" stored in the control parameter storage area 40 by (b) a value obtained by subtracting the dark level of "the specular reflection output Vsp_drk" from "the belt base specular reflection output at a black patch position Vspk_base" and further subtracting "the filled black specular reflection level bk_sld."

However, in this embodiment "the black toner-base ratio Krt'" is calculated from equation (2) below.

$$Krt'=(Vspk_pat-Vsp_drk-bk_sld*\text{coef})/(Vspk_\text{base}-Vsp_drk-bk_sld*\text{coef}) \quad (2)$$

Specifically, in this embodiment, the CPU 31 first multiplies the filled black specular reflection level bk_sld by the correction coefficient coef to correct the filled black specular reflection level bk_sld, i.e., obtain the actual filled black specular reflection level bk_sld. Both of the filled black specular reflection level bk_sld and the correction coefficient coef are stored in the control parameter storage area 40. The correction coefficient coef is calculated according to the sensitivity adjustment program 37 described in FIG. 13. The CPU 31 then calculates the corrected reflected intensity from the black patch 62K by subtracting the dark level of the specular reflection output Vsp_drk from the black patch specular reflection output Vspk_pat and further subtracting the corrected filled black specular reflection level bk_sld*coef.

Next, the CPU 31 calculates the intensity of corrected reflection from the conveying belt 8 by subtracting the dark level of the specular reflection output Vsp_drk from the belt base specular reflection output at a black patch position Vspk_base and further subtracting the corrected filled black specular reflection level bk_sld*coef.

Next, the CPU 31 calculates the black toner-base ratio Krt' by dividing the corrected reflection amount for the black patch 62K by the corrected reflection amount for the conveying belt 8. By correcting the reflection amounts for the black patch 62K and the conveying belt 8 with the correction coefficient coef, it is possible to eliminate variations in distance from the density sensor 20 to the conveying belt 8 and variations in directivity of the infrared LED 21*a* and the specular reflection photodiode 22*a*.

Next, the CPU 31 calculates a density N1 by referencing the lookup table 39 stored in the ROM 33 with "the calculated black toner-base ratio Krt'."

The density of color toner is calculated as follows. Since the method of calculation is identical for each color of toner, the density calculation for cyan toner will be used as an example.

While the shutter 24 is in the retracted position indicated by the solid line in FIG. 4, the infrared LED 21*a* projects infrared light on the cyan patch 62C using the light emission setting col_led_pwm for measuring diffuse reflection, which is saved in the RAM 34 in S4, while the diffuse reflection photodiode 22*b* receives light reflected off the cyan patch 62C. The CPU 31 stores the output from the diffuse reflection photodiode 22*b* in the RAM 34 as a cyan patch diffuse reflection output Vdfc_pat.

Conventionally, the cyan toner-reference plate ratio Crt has been calculated according to equation (3) below.

$$\begin{aligned} Crt &= \{(\mathrm{Vdfc_pat} - \mathrm{Vdf_drk}) - (\mathrm{Vdfc_base} - \mathrm{Vdf_drk})\} / (\mathrm{Vdf_std} - \mathrm{Vdf_drk}) \\ &= (\mathrm{Vdfc_pat} - \mathrm{Vdfc_base}) / (\mathrm{Vdf_std} - \mathrm{Vdf_drk}) \end{aligned} \tag{3}$$

Specifically, diffuse reflection output for the cyan patch 62C excluding the diffuse reflection component for the base is found by subtracting "the belt base diffuse reflection output at a cyan patch position Vdfc_base" from "the cyan patch diffuse reflection output Vdfc_pat." This value is divided by the diffuse reflection output from the print film 25 found by subtracting the belt base diffuse reflection output at "a cyan patch position Vdfc_base" from "the reference plate diffuse reflection output for measuring color patches Vdf_std". Finally, the ratio of the reflection intensity when detecting cyan toner and the reflection amount for the print film 25 is found.

However, in this embodiment the CPU 31 calculates the cyan toner-reference plate ratio Crt' according to equation (4) below.

$$Crt' = Crt/\mathrm{coef} \tag{4}$$

Hence, in this embodiment the CPU 31 divides "the cyan toner-reference plate ratio Crt" by "the correction coefficient coef." This method calculates "a cyan toner-reference plate ratio Crt'" that eliminates effects resulting from individual differences, such as irregularities in the distance from the density sensor 20 to the conveying belt 8, and directivity irregularities in the infrared LED 21*a* and the diffuse reflection photodiode 22*b*.

Next, the CPU 31 calculates a toner density N2 by referencing the lookup table 39 stored in the ROM 33 with "the cyan toner-reference plate ratio Crt'" calculated above.

After calculating the density of each color toner, as described above, in S10 the CPU 31 determines whether there is any toner patch error.

More specifically, the CPU 31 reads "the black patch density determining values Vsp_belt_min,max" and "the color patch density determining values Vdf_belt_min,max" from the control parameter storage area 40. The CPU 31 outputs an error flag if the calculated densities for any color toner falls outside "the black patch density determining values Vsp_belt_min,max" or "the color patch density determining values Vdf_belt_min,max."

When the CPU 31 determines that an error has occurred, in S11 the CPU 31 drives the cleaner 26 to remove the toner patches from the conveying belt 8.

Figure 13:
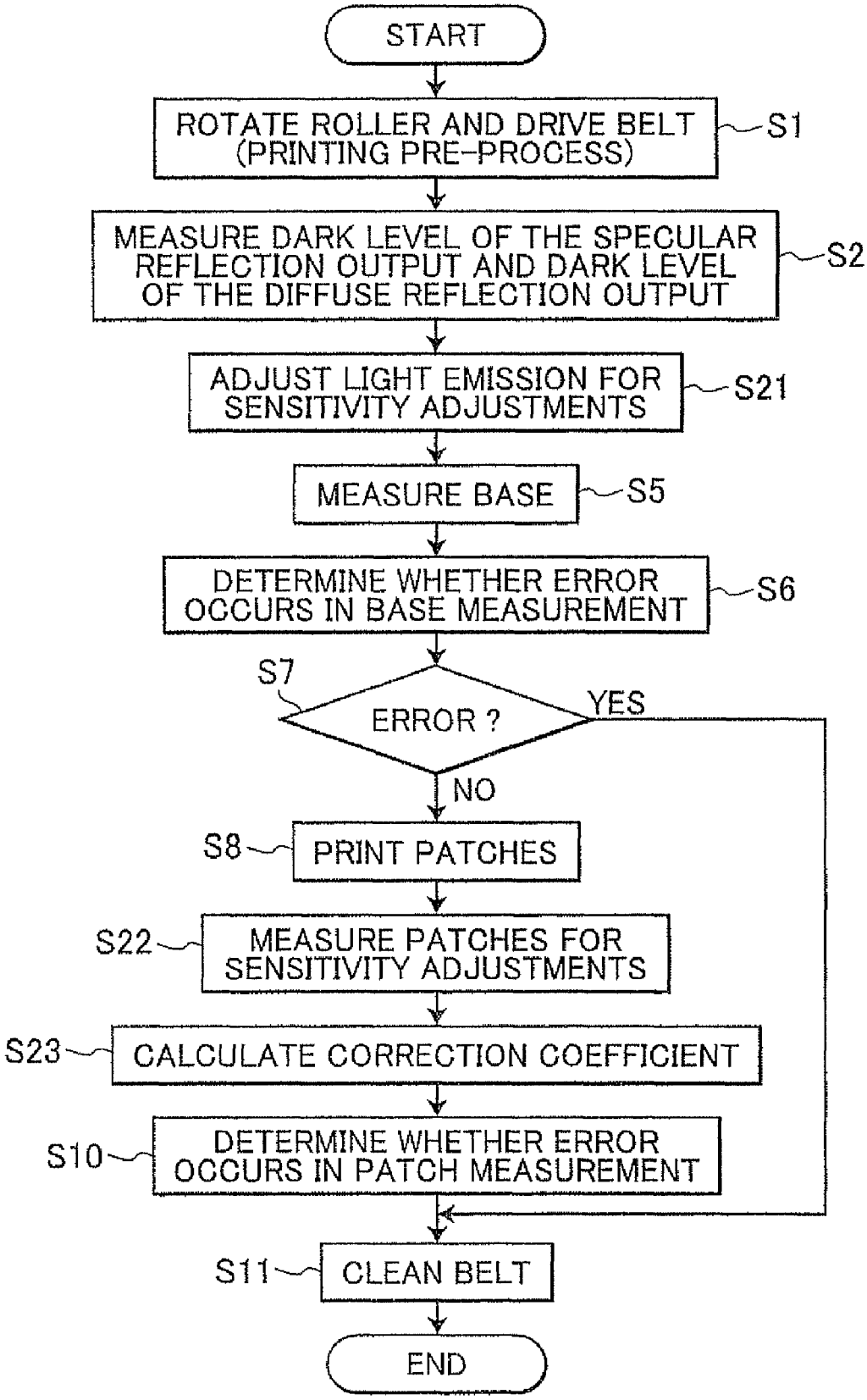
FIG. 13 is a flowchart illustrating a sensitivity adjustment program.

Next, the correction amount calculating function of the printer 1 will be described. FIG. 13 is a flowchart illustrating steps performed according to the sensitivity adjustment program 37.

The correction amount calculating function is executed during product assembly and during maintenance by copying the sensitivity adjustment program 37 from the EEPROM 35 to the RAM 34, and by calculating the correction coefficient coef and storing the calculated value in the control parameter storage area 40. Since the sensitivity adjustment program 37 is a partial modification of the patch measurement program 38, the following description will focus on differences between the two programs with similar steps designated with the same step numbers to avoid duplication description.

When the program 37 starts, the steps S1 and S2 are executed. Then, in S21 of the sensitivity adjustment program 37, the CPU 31 adjusts the intensity of light for sensitivity adjustments. Specifically, the CPU 31 reads "the initial sensitivity adjustment light emission setting x0_led_pwm" from the control parameter storage area 40. Since black toner has a very small diffuse reflection component, "the initial sensitivity adjustment light emission setting X0_ed_pwm" is set to a higher value than "the initial specular reflection light emission setting bk0_led_pwm" and "the initial diffuse reflection light emission setting co10_led_pwm".

While the shutter 24 is in the shielding position indicated by the dotted line in FIG. 4, the CPU 31 begins operating the sensor 20 with "the initial sensitivity adjustment light emission setting X0_led_pwm," controlling the infrared LED 21*a* to project infrared light, while the diffuse reflection photodiode 22*b* receives infrared light reflected off the print film 25. The CPU 31 gradually increases the intensity of light emitted from the infrared LED 21*a* by steps (add_pwm) until the intensity of received light reaches a prescribed value (X_std_tglvl). Here, the adjusted intensity of received light is set to a value excluding the dark output component.

The diffuse reflection photodiode 22*b* is used to adjust the intensity of diffused light received in order to facilitate sensitivity adjustments in the region at which the sensor output is saturated (see region B in FIG. 11).

The CPU 31 may output an error message if the intensity of received light exceeds a prescribed level (X_std_max) for the initial sensitivity adjustment light emission setting X0_led_pwm. The CPU 31 may also output an error message and cancel the program 37, if the intensity of emitted light is increased and the duty cycle of the PWM signal exceeds the determining value (X_led_pwm_max) before the intensity of diffuse reflection light received is in the normal range.

After adjusting the intensity of light emitted for sensitivity adjustments, the CPU 31 stores this light emission setting (X_led_pwm) in the RAM 34. The CPU 31 also stores the diffuse reflection light emission level when measuring the reference plate (the print film 25 fixed on the rear surface of the shutter 24) in the RAM 34, as the reference plate diffuse reflection amount for measuring "the filled black patch Vdfb_std".

By adjusting the intensity of light for sensitivity adjustments in this way, the CPU 31 can equalize the intensity of light emitted from the infrared LED 21*a*, even when the intensity of light emitted from the infrared LED 21*a* varies due to the usage environment, usage time, or amount of current, for example.

In S22 the CPU 31 measures the toner density of the filled black patch 61. Specifically, while the shutter 24 is in the retracted position indicated by the solid line in FIG. 4, the infrared LED 21*a* projects infrared light onto the filled black patch 61 printed on the conveying belt 8, using "the sensitivity adjustment light emission setting X_led_pwm" that is saved in the RAM 34 in S21, while the diffuse reflection photodiode 22*b* receives the light reflected off the filled black patch 61. The CPU 31 stores output from the diffuse reflection photodiode 22*b* in the RAM 34 as "a patch diffuse reflection output for sensitivity adjustment Vdfbk_pat".

In S23 the CPU 31 calculates the correction coefficient coef according to equation (5) below.

$$\text{coef}=(Vdfbk_pat/Vdfb_std)*(1/Krt_std) \quad (5)$$

Specifically, the CPU 31 calculates the correction coefficient coef by multiplying (a) a value obtained by dividing "the patch diffuse reflection output for sensitivity adjustment Vdfbk_pat" by "the reference plate diffuse reflection amount for measuring the filled black patch Vdfb_std" by (b) an inverse of "the filled black standard reference Krt_std" stored in the control parameter storage area 40.

The correction coefficient coef is a coefficient for correcting the difference between the design value and the actual value of the ratio of the intensities of reflected light from the patch and the reference plate. If the actual value is identical with the design value, the correction coefficient coef is equal to "1".

The correction coefficient coef is calculated during assembly or maintenance of the printer 1 and then stored in the control parameter storage area 40. When the user starts up the printer 1 for the first time, or inputs a density detection command in the printer 1, the printer 1 executes a calibration process using the toner density of the patches 62 measured by the density sensor 20 and the correction coefficient coef stored in the control parameter storage area 40.

For example, if the design value for "a sensitivity adjustment patch measurement value bkpat_lvl" is 51 and the design value of "a sensitivity adjustment reference measurement value sadj_lvl is 510," "the filled black standard reference Krt_std" is set to 0.1.

For example, when the distance from the density sensor 20 to the conveying belt 8 is shorter than the design value and the distance between the light-emitting element 21 and shutter 24 is short, the sensitivity of the light-receiving element 22 is higher at the position of the shutter 24. Since the light intensity detected by the light-emitting element 21 is less than the design light intensity in this case, the sensitivity adjustment patch measurement value bkpat_lvl is 10% lower than the design value (51), for example, or 45.9.

Using equation 5 described above, the CPU 31 first divides 45.9, which is "the sensitivity adjustment patch measurement value bkpat_lvl," by 510, which is "the sensitivity adjustment reference measurement value sadj_lvl" to obtain the result, and then multiplies the result by 0.1, which is "the filled black standard reference Krt_std," to calculate the correction coefficient coef of 0.9. The CPU 31 stores the correction coefficient coef in the control parameter storage area 40.

If the print film 25 provided on the shutter 24 has a higher reflectance, then the intensity of light received by the light-emitting element 21 is less than the design value, resulting in a smaller "sensitivity adjustment reference measurement value sadj_lvl". In such a case, the CPU 31 can calculate the correction coefficient coef corresponding to deviation generated by the print film 25 using equation 1 described above.

Alternatively, if the distance from the density sensor 20 to the conveying belt 8 is greater than the design value and the distance between the density sensor 20 and shutter 24 is longer, the print film 25 provided on the shutter 24 may have a lower reflectance or the sensitivity of the light-receiving element 22 for the position of the shutter 24 may be lowed. In such cases, the intensity of detection light emitted from the light-emitting element 21 may be greater than the design value; "the sensitivity adjustment patch measurement value bkpat_lvl" of the filled black patch 61 may be 10% higher than the design value (51), or 56.1; and the sensitivity adjustment reference measurement value sadj_lvl may be 3% higher than the design value, or 525.3.

Accordingly, by using the equation (1), the CPU 31 first dividing 56.1, which is "the sensitivity adjustment patch measurement value bkpat_lvl,# by 525.3, which is "the sensitivity adjustment reference measurement value sadj_lvl," and then multiplies the result by the standard reference 0.1 to obtain a correction coefficient of 1.07 (rounding off the third place to the right of the decimal). This value is stored in the control parameter storage area 40 as the correction coefficient coef.

If the printer 1 is configured to perform density detections when powered on, for example, the CPU 31 calibrates the amount (density) of toner detected by the density sensor 20 using the correction coefficient coef stored in the control parameter storage area 40 during the assembly process. Specifically, the CPU 31 substitutes the correction coefficient coef into equations (2) and (4) to find "the black toner-base ratio Krt'" and "the color toner-reference plate ratios Yrt', Mrt', and Crt'" corrected by the correction coefficient coef. The CPU 31 then calculates the toner density for each color by referencing the lookup table 39 with the corrected ratios Krt', Yrt', Mrt', and Crt'. The image forming conditions of the image-forming unit 4 are automatically set based on the results of these calculations.

With the printer 1 and the sensitivity adjustment program 37 described above, the ratio of "the sensitivity adjustment patch measurement value bkpat_lvl" acquired with reference to the filled black patch 61 when the print film 25 is in the retracted position indicated by the solid line in FIG. 4, and "the sensitivity adjustment reference measurement value sadj_lvl" acquired with reference to the print film 25 when the print film 25 is in the shielding position is used for calculating the correction coefficient coef for correcting output values from the density sensor 20 (see equation (5) and S23 of FIG. 13).

The ratio of "the sensitivity adjustment patch measurement value bkpat_lvl" and "the sensitivity adjustment reference measurement value sadj_lvl" is taken to find the relationship between reflection characteristics based on a unique print film 25 in the printer 1 and reflection characteristics based on the filled black patch 61 formed on the conveying belt 8 in order to eliminate irregularities in the toner quantity detection characteristics caused by irregularities among products or during assembly, such as directivity irregularities in the specular reflection photodiode 22*a* and diffuse reflection photodiode 22*b*, irregularities in the distance from the density sensor 20 to the conveying belt 8, or irregularities in reflection characteristics of the print film 25.

Hence, the printer 1 and sensitivity adjustment program 37 can reduce irregularities in detection characteristics caused by individual differences among printers 1 in order to stabilize the density detection characteristics among products.

Further, since the positional relationships among the conveying belt 8, shutter 24, and density sensor 20 change very little after the printer 1 is assembled, the printer 1 calculates the correction coefficient coef after product assembly or during maintenance and stores this correction coefficient coef in the control parameter storage area 40. Accordingly, the printer 1 can reduce the amount of waste toner since the correction coefficient coef need not be calculated each time the patch measurement program 38 is executed for detecting the toner quantities.

Further, when executing the patch measurement program 38 when the device is powered on, the printer 1 finds "the black toner-base ratio Krt'" and "the color toner-reference plate ratios Yrt', Mrt', and Crt'" corrected with the correction coefficient coef, and corrects the toner density detected by the density sensor 20 by referencing the lookup table 39 with these ratios to find the density. Hence, the printer 1 can improve the accuracy of detecting toner density by eliminating irregularities among individual products in the toner density calculated by the density sensor 20.

Further, in the printer 1, the filled black patch 61 formed on the conveying belt 8 for calculating the correction coefficient coef is formed by depositing a sufficient amount of toner for essentially saturating the output value of the diffuse reflection photodiode 22*b* when detecting the density of deposited toner, as illustrated in the region B of FIG. 11. Hence, within the region B of FIG. 11, the printer 1 can obtain a uniform sensor output despite slight irregularities in density. Accordingly, the printer 1 can calculate a correction coefficient suitable to the device with great accuracy.

While the invention has been described in detail with reference to specific embodiments thereof, it would be apparent to those skilled in the art that many modifications and variations may be made therein without departing from the spirit of the invention, the scope of which is defined by the attached claims.

For example, the image-forming device may be a multifunction device having a plurality of functions (printer function, facsimile function, copier, function, scanner function, and the like), a facsimile device, or a copier, as well as the printer 1 described above.

Further, the printer may transfer toner deposited on the photosensitive drum to a conveying belt, and subsequently transfer the toner from the conveying belt to the recording paper in order to form the toner image on the recording paper.

Further, the above embodiment treats sampled values for the dark level of "the specular reflection output dark level of the diffuse reflection output Vdf_drk;" "belt base specular reflection output at a black patch position Vspk_base;" "belt base diffuse reflection output at a cyan patch position Vdfc_base;" "belt base diffuse reflection output at a magenta patch position Vdfm_base;" "belt base diffuse reflection output at a cyan patch position Vdfc_base;" "reference plate diffuse reflection output for measuring color patches Vdf_std;" "reference plate diffuse reflection amount for measuring the filled black patch Vdfb_std;" "black patch specular reflection output Vspk_pat;" and "the patch diffuse reflection output Vdfy_pat, Vdfm_pat, and Vdfc_pat" for each color as single values. However, the printer 1 may instead acquire a plurality of each of the above sampled values when executing the sensitivity adjustment program 37 and patch measurement program 38. In such a case, the printer 1 may average the sample values before performing density correction.

In the above embodiment, the sensitivity adjustment program 37 is stored in the EEPROM 35 in advance. However, the sensitivity adjustment program 37 may be stored on a CD-ROM or other storage medium. A technician or a service repairman may load the sensitivity adjustment program 37 from the CD-ROM into the RAM 34 or EEPROM 35 during product assembly or maintenance in order to acquire the correction coefficient coef.

Further, the reflecting reference member used in the above embodiment may be coated with a resin having a prescribed reflectance as the print film 25. Further, rather than integrating the print film 25 and shutter 24, as in the above embodiment, the print film 25 may be capable of moving independently of the shutter 24.

The light-receiving element 22 may be provided with the single specular reflection photodiode 22*a* when the image-forming device is a monochrome printer, for example. Further, the light-emitting element 21 may be provided with a light-emitting element of a different type than the infrared LED 21*a*.

What is claimed is:

1. An image-forming device, comprising:

an image-forming unit that forms a toner image on an image-carrying member;

a toner density detection unit that detects a toner density of the toner image, the toner density detection unit having a light-emitting element for emitting a light beam to the image-carrying member, and a light-receiving element for receiving the light beam to produce an output value based on an intensity of the received light beam;

a reflective shutter provided between the toner density detection unit and the image-carrying member to be movable between a shielding position and a retracted position;

a storage unit that stores the output value of the toner density detection unit; and a control unit that calculates a correction value for correcting the output value to control an image-forming unit according to the correction value, wherein the image-forming unit forms a reference toner image on the image-carrying member, the toner density detection unit receives a reflected light beam from the reflective shutter positioned at the shielding position to generate a first output value, the first output value being stored in the storage unit, the toner density detection unit receives another reflected light beam from the reference toner image to generate a second output value when the reflective shutter is positioned at the retracted position, the second output value being stored in the storage unit, and the control unit calculates a ratio of the second value and the first value and then calculates the correction value based on the ratio.

2. The image-forming device according to claim 1, wherein the image-forming unit forms the toner image with an image-forming condition, the storage unit stores the correction value, and the control unit sets the image-forming condition according to the correction value.

3. The image-forming device according to claim 1, wherein the reference toner image is a toner patch having a toner density which saturates the output value of the toner density detection unit.

4. The image-forming device according to claim 2, wherein the image-forming unit forms a measuring toner image on the image-carrying member, the toner density detection unit detects a toner density of the measuring toner image, and the control unit corrects the detected toner density of the measuring toner image with the correction value.

5. A computer program recorded on a computer readable recording medium for operating an image-forming device, executable by a computer, the image-forming device having: an image-forming unit that forms a toner image on an image-carrying member; a toner density detection unit that detects a toner density of the toner image, the toner density detection unit having a light-emitting element for emitting a light beam to the image-carrying member, and a light-receiving element for receiving the light beam to produce an output value based on an intensity of the received light beam; a reflective shutter provided between the toner density detection unit and the image-carrying member to be movable between a shielding position and a retracted position; and a control unit that calculates a correction value for correcting the output value to control the image-forming unit, comprising:

instructions for receiving reflect light from the reflective shutter positioned at the shield position to generate a first output value, instructions for forming a reference toner image on the image-carrying member, instructions for receiving another reflected light from the reference toner image to generate a second output value when the reflective shutter is positioned at the retracted position, and instructions for calculating a ratio of the second value and the first value to calculate the correction value based on the ratio.

6. A toner density detection device used for an image-forming device including an image-carrying member to carry a toner image formed having a toner density thereon, the toner density detection device detecting the toner density, comprising:

a light-emitting unit that emits light to the image-carrying member;

a light-receiving unit that receives the light to produce an output value based on an intensity of the received light beam;

a reflective shutter for the light-emitting unit and being movable between a shielding position and a retracted position;

a storage unit that stores the output value of the light receiving unit; and a control unit that calculates a correction value for correcting the output value based on a reference toner image formed on the image-carrying member, the control unit producing the toner density, using the correction value, wherein the light-receiving unit receives the light from the reflective shutter positioned at the shielding position to generate a first output value, the first output value being stored in the storage unit, the light-receiving unit receives the light from the reference toner image to generate a second output value when the reflective shutter is positioned at the retracted position, the second output value being stored in the storage unit, and the control unit calculates a ratio of the second value and the first value and then calculates the correction value based on the ratio.

* * * * *